United States Patent [19]

Ellis

[11] 3,951,211

[45] Apr. 20, 1976

[54] METHOD FOR SELECTIVELY RETRIEVING A PLURALITY OF WELL PACKERS

[75] Inventor: Gary Dale Ellis, Dallas, Tex.

[73] Assignee: Dresser Industries, Inc., Dallas, Tex.

[22] Filed: July 31, 1975

[21] Appl. No.: 601,121

[52] U.S. Cl. ..... 166/315; 166/181

[51] Int. Cl.[2] ..... E21B 33/12; E21B 13/124

[58] Field of Search ..... 166/315, 123, 124, 125, 166/143, 181, 191

[56] References Cited

UNITED STATES PATENTS

| | | | |
|---|---|---|---|
| 1,797,177 | 3/1931 | Nixon et al. | 166/143 |
| 2,537,066 | 1/1951 | Lewis | 166/125 X |
| 2,618,340 | 11/1952 | Lynd | 166/191 X |
| 2,806,532 | 9/1957 | Baker et al. | 166/123 X |
| 3,100,533 | 8/1963 | Fredd | 166/181 |
| 3,818,987 | 6/1974 | Ellis | 166/124 |

*Primary Examiner*—Stephen J. Novosad
*Attorney, Agent, or Firm*—Michael J. Caddell

[57] ABSTRACT

A method of operating a plurality of well packers in a borehole involves selectively retrieving one or more of the well packers on a single trip of the production string or a work string out of the borehole.

4 Claims, 6 Drawing Figures

METHOD FOR SELECTIVELY RETRIEVING A PLURALITY OF WELL PACKERS

BACKGROUND OF THE INVENTION.

In the production of hydrocarbons from a plurality of underground formations penetrated by a single borehole, it is not unusual for this to be advantageously accomplished by the use of a plurality of well packers along the length of the wellbore to isolate certain formations or sections of formations from other formations or the rest of the wellbore. This procedure is often termed a stacked installation when speaking of the tools and packers used therein.

One method of establishing a stacked installation is to run a string of production tubing into the borehole with a packer located at the bottom and setting the packer at the lowermost position in the wellbore which has not yet received a packer. Using this method, each packer must be placed individually and each requires a separate trip of the work string for placement.

Alternatively, several packers may be run in a hole at the same time on a single work string or tubing string to be set simultaneously by hydraulic or mechanical means. Removal of the packers requires removal of all of the packers at one time with the work string or tubing string on which they were run in.

The present invention contemplates a method of running a plurality of packers into a borehole and selectively retrieving any portion of the number of packers, leaving those below the retrieved packers to remain in the borehole.

DESCRIPTION OF THE PREFERRED EMBODIMENTS

Figure 1:
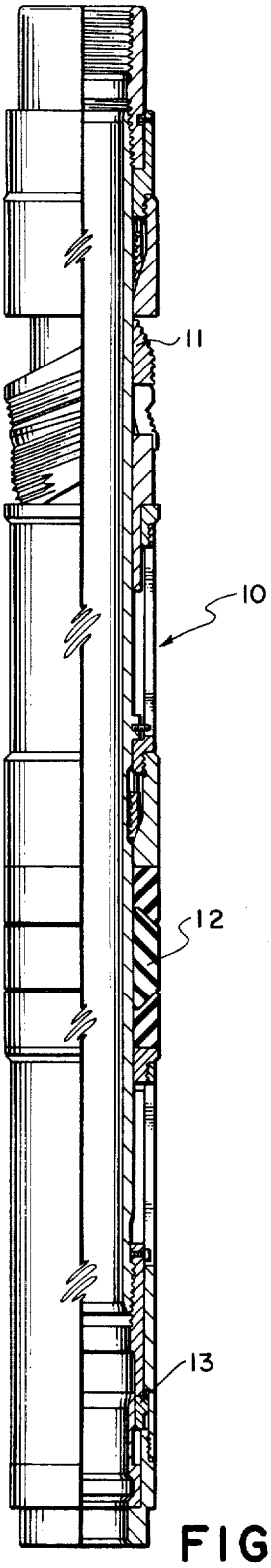
FIG. 1 is a partial cross-sectional view of a packer assembly of this invention.

Referring to FIGS. 1 through 5, a packer and a well retrieving assembly are illustrated. The structure of the packer assembly is identical to that disclosed in U.S. Pat. No. 3,818,987, the specification and illustrations of which are herein incorporated by reference into this application. The well packer assembly 10 is shown in partial cross-sectional elevated view in FIG. 1 as having an unitary partially rotatable gripping member 11, elastomeric expandable packer means 12 and retrieving engagement assembly 13.

Figure 2:
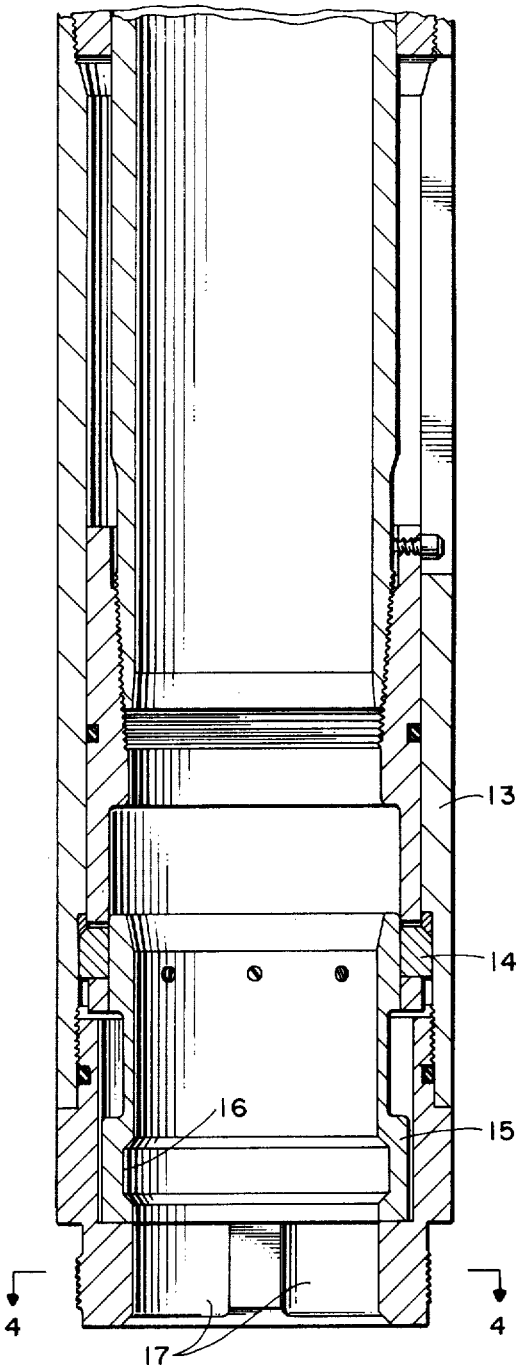
FIG. 2 is an enlarged cross-sectional view of the lower end of the assembly of FIG. 1.

FIG. 2 illustrates an enlarged cross-sectional view of the packer retrieval assembly 13 which comprises the lower end of packer assembly 10. Retrieval mechanism 13 comprises a locking dog apparatus 14 held in locking position by retainer sleeve 15 slidably and shearably held within the packer mechanism. A locking groove 16 is provided internally in retaining sleeve 15 and a plurality of grooves 17 are formed in the inner wall of the lower end of the packer housing. Specific operation of the retrieval mechanism may be ascertained from the aforementioned incorporated patent.

Figure 4:
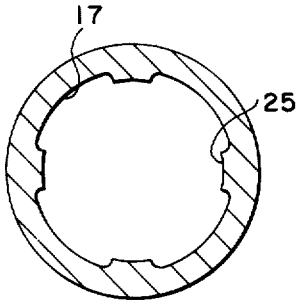
FIG. 4 is an axial cross-sectional view taken at line 4—4 in FIG. 2.

FIG. 4 is an axial cross-sectional view of the lower end of the packer mechanism better illustrating the axial slots 17 formed therein.

Figure 3:
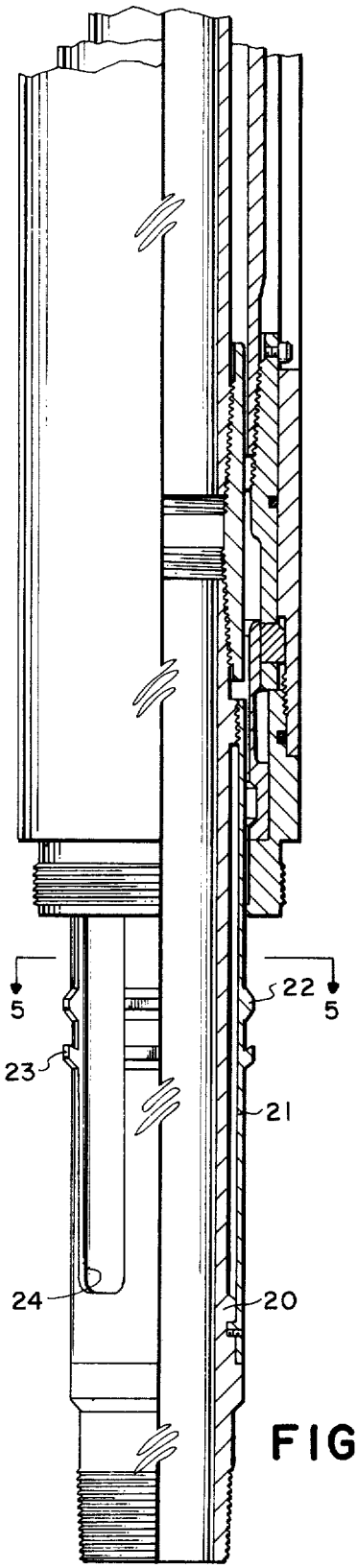
FIG. 3 is a partial cross-sectional view of the lower portion of the packer assembly of FIGS. 1 and 2 with a retrieval apparatus engaged therein.

FIG. 3 is a partial cross-sectional view of a retrieval tool to be utilized with the well packer 10 for engaging in the retrieval mechanism 13 and releasing the well packer from the well. As can be seen in FIG. 3, the retrieval tool comprises an inner mandrel 20 and an outer spring finger mandrel 21 having engagement shoulders 22 and 23 formed thereon. The outer sleeve 21 has a plurality of window openings 24 cut therethrough between the shoulders 23 and 22 to provide a flexibility of those portions of the sleeve which mount the shoulders 22 and 23.

Operation of the retrieval tool within the lower retrieval mechanism of packer 10 is accomplished by proper movement of the retrieval tool through the lower grooved portion of the packer housing as more specifically set out in the aforementioned incorporated U.S. Pat. No. 3,818,987. Broadly, operation of the retrieval tool is carried out by properly orienting the shoulders 22 and 23 within grooves 17 for retention of the retaining collar 15 via channel 16. Thus, when it is desirable to retrieve the packer, shoulders 22 and 23 will move through axial grooves 17 allowing flexure outward of upper shoulders 22 into channel 16 thereby allowing disengagement of the packer from the well.

When it is desirable to pull the retrieval tool through the packer without unsetting it, this may be accomplished by orienting the retrieval tool so that the shoulders 22 and 23 contact the raised portions 25 formed between grooves 17 in the lower end of the packer assembly.

Figure 5:
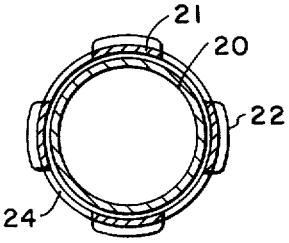
FIG. 5 is an axial cross-sectional view taken at line 5—5 of FIG. 3.

FIG. 5 illustrates a cross-sectional view of the retrieval tool illustrating the shoulders 22 formed thereon. Thus, it can be seen from the brief description of the operation given above and from the more detailed description of operation given in the aforementioned incorporated U.S. Patent, that movement of the retrieval tool 21 upward and downward within well packer 10 may be accomplished without interfering with the operation or maintenance of the well packer in its set condition. Movement of the retrieval tool may selectively unset and retrieve the packer or alternatively may have no affect upon it all depending upon the desire of the operator when moving the tool through the packer.

Figure 6:
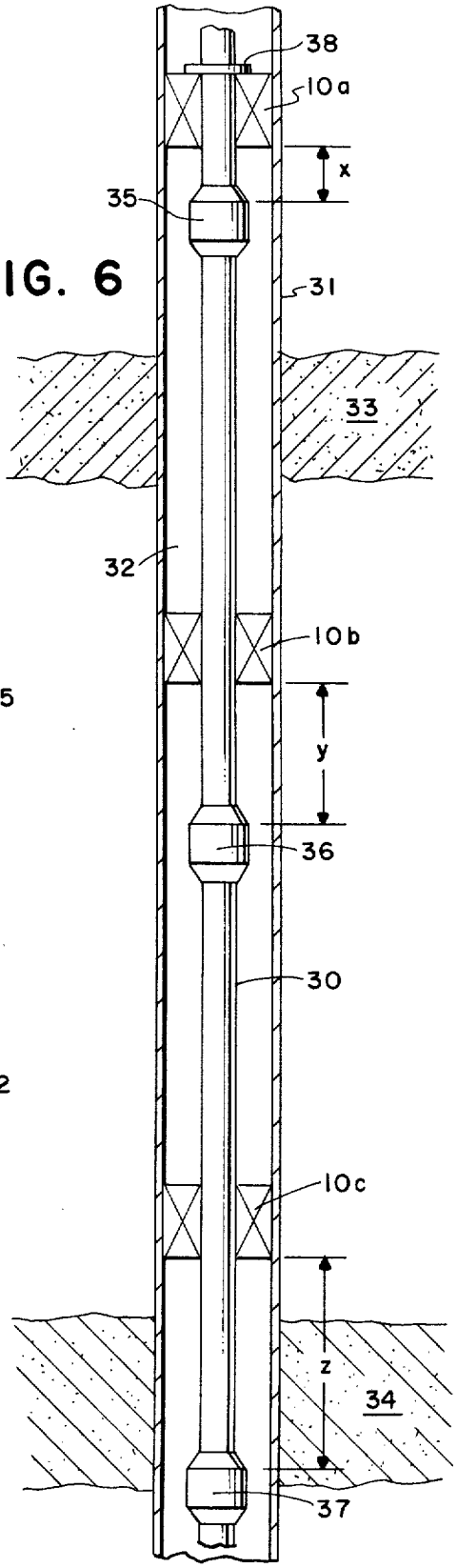
FIG. 6 is a schematic view of the apparatus in the borehole.

In the present invention, a plurality of packers such as the packer 10 are shown in FIG. 6 at 10*a*, 10*b* and 10*c* located sealingly and slidably on a tubing string 30 with packers 10 being expanded into engagement with the inner wall of casing 31. The borehole 32 may penetrate two or more producing formations such as 33 and 34 with the packers 10 being placed strategically to isolate one formation from the other. Perforations in the casing provide communication from bore 32 to the various producing formations.

The tubing string 30 preferably has attached thereon a plurality of retrieving tools 35, 36 and 37. A locator flange 38 is also secured to the tubing string above retrieving tool 35. The spacing of the retrieving tools 35, 36 and 37 is particularly important with respect to this invention in that it is preferable that the spacing of the uppermost retrieval tool is less than each of the lowermost retrieving tools below their respective packers. The spacing between retrieval tool 35 and its respective packer 10*a* is denoted at X; likewise, the spacing between retrieval tool 36 and packer 10*b* is denoted at Y and that between tool 37 and packer 10*c* denoted at Z. Thus it is preferable that X be less than Y, and Y be less than Z, and each such spacing dimension be greater progressing downward on the tool string 30.

The locator flange 38 allows the tubing string to be placed in the proper orientation within the various packers without extending too far therebelow. It should also be noted that the sizing of the various retrieval tools and inner portions of the various packers is also important. The general rule for sizing is that the internal bore or opening through each packer should be equal to or greater than that of the next lower packer.

In typical operation, the well packers 10 may be located on a work string in proper placement for selectively isolating the various underground formations within the wellbore. The work string with the packers attached thereon is lowered into the well and the packers are set by means such as hydraulic actuation or vertical reciprocation of the string or rotational manipulation of the string or any other acceptable methods of setting the packers. The string may then be withdrawn from the well and the producing string 30 having the retrieval tools 35–37 attached thereon in proper placement with respect to the packers 10 is lowered into the well and stabbed through the packers until locator flange 38 bottoms-out on top the uppermost packer 10*a*.

Alternatively, the packers 10 may be run in place on string 30 and actuated into packer engagement within casing 31. After setting of the packers and at any time thereafter when it is desirable to remove one or more of the packers, this may be accomplished by picking up on work or production string 30 until retrieval tool 35 is properly engaged within packer 10*a* such that unseating of the packer and removal from the wellbore is accomplished. Assuming that packer 10*a* is the only one desired to be removed, then retrieval tools 36 and 37 are manipulated through packers 10*b* and 10*c* in such a manner as to not interfere with the setting engagement of these two packers. However should it be desirable to remove packer 10*b* or both packers 10*b* and 10*c*, this could be accomplished simultaneously with the removal of packer 10*a* by the proper engagement of retrieval tool 36 in 10*b* after unsetting 10*a* such that packer 10*b* is also activated into unsetting.

After the unsetting of packer 10*b*, the retrieving tool 37 will engage packer 10*c*, and proper positioning of tool 37 in packer 10*c* will thereafter disengage this packer from the well also. It is clear to see that any number of packers can be run on string 30 and retrieved selectively one or more at a time, beginning from the top down, by properly locating the packers on the string with respect to each packers retrieval tool and by proper manipulation of the string 30 when removing it from the wellbore to selectively disengage and remove the desirable packers.

Thus any number of the packers may be removed from the well with one trip of the string 30 while leaving in the well any desired number of packers therebelow. This saves from one to many trips of the tubing string in and out of the well when it is desirable to remove more than one packer.

Although certain preferred embodiments of the present invention have been herein described in order to provide an understanding of the general principles of the invention, it will be appreciated that various changes and innovations can be effected in the described method for placement and retrieval of packers without departing from these principles. All modifications and changes are deemed to be embraced by the spirit and scope of the invention except as the same may be necessarily limited by the appended claims or reasonable equivalents thereof.

The embodiments of the invention in which an exclusive property or privilege is claimed are defined as follows:

1. A method of selectively simultaneously retrieving one or more well packers from a wellbore on a single run of conduit, said method comprising:

locating in a spaced apart relationship in a wellbore a plurality of well packers having relatively open seal bores therethrough;

placing said packers in said wellbore such that each successive packer has a seal bore of equal or larger diameter than the next lower packer;

locating in said wellbore in sealing, slidable relationship in said packer bores a work or production string having retrieval tools thereon selectively capable of alternatively traversing said packers or unsetting said packers;

spacing said retrieval tools on said work or production string below said packers with the incremental distance of each retrieval tool below each packer being greater than the incremental distance between each successive next upper packer and retrieval tool; and, when desirable, manipulating said work or production string while pulling it upward through said packers to engage any one or more of the uppermost retrieval tools with their associated packers in order to unseat and remove said one or more packers.

2. A method of isolating one or more underground formations in a wellbore with a plurality of well packers on a tubing string, and subsequently selectively retrieving any one or more of the packers on a single trip of the tubing string out of the wellbore, said method comprising:

assembling a string of conduit together with a plurality of retrieval tools located in spaced relation thereon;

placing a plurality of well packers on said conduit string in slidable sealing relationship, with generally one packer above each of said retrieval tools;

said retrieval tools and said packers being spaced on said conduit string to provide desirable isolation of the underground formations when placed in said borehole;

lowering said conduit string into said borehole and setting said well packers in sealing engagement in the borehole; and, after a predetermined period of time, manipulating said conduit string while pulling it out of said borehole to unseat and retrieve one or more of the uppermost well packers.

3. The method of claim 2 wherein said manipulation step further comprises rotating said conduit string while pulling it from the borehole.

4. A method of selectively retrieving one or more of a plurality of packers set in a borehole and having relatively open bore passages therethrough, said method comprising:

lowering into the borehole through the bore passages of said packers a work or production string having located thereon in spaced relationship a retrieval tool for each said packer to be removed;

lowering each said retrieval tool through each said packer to be removed; and, pulling said work or production string out of the borehole while manipulating said string to engage each said retrieval tool with its associated packer thereby unsetting and retrieving each said packer.

* * * * *